US007427848B2

(12) United States Patent
Holtman et al.

(10) Patent No.: US 7,427,848 B2
(45) Date of Patent: Sep. 23, 2008

(54) SKEW CORRECTION SYSTEM AND METHOD OF CONTROLLING A SKEW CORRECTION SYSTEM

(75) Inventors: Lodewijk T. Holtman, Venlo (NL); Peter G. La Vos, Baarlo (NL); Cornelis W. M. Venner, Meijel (NL)

(73) Assignee: Oce-Technologies B.V., Venlo (NL)

( * ) Notice: Subject to any disclaimer, the term of this patent is extended or adjusted under 35 U.S.C. 154(b) by 113 days.

(21) Appl. No.: 11/603,183

(22) Filed: Nov. 22, 2006

(65) Prior Publication Data

US 2007/0120517 A1 May 31, 2007

(30) Foreign Application Priority Data

Nov. 25, 2005 (EP) ..... 05111302

(51) Int. Cl.
*G05B 19/40* (2006.01)

(52) U.S. Cl. ..... 318/685; 318/696

(58) Field of Classification Search ..... 318/685, 318/696, 632, 638

See application file for complete search history.

(56) References Cited

U.S. PATENT DOCUMENTS 5,322,273 A * 6/1994 Rapkin et al. ..... 271/227
5,917,727 A 6/1999 Richardson et al.
5,918,876 A 7/1999 Maruyama et al.
6,115,146 A * 9/2000 Suzuki et al. ..... 358/474
6,170,933 B1 * 1/2001 Nitta et al. ..... 347/42
6,374,075 B1 4/2002 Benedict et al.
6,501,930 B2 * 12/2002 Oku ..... 399/167
2002/0027592 A1 * 3/2002 Sakai et al. ..... 347/218

FOREIGN PATENT DOCUMENTS

EP 1054301 A2 11/2000

* cited by examiner

*Primary Examiner*—Rina I Duda
(74) *Attorney, Agent, or Firm*—Birch, Stewart, Kolasch & Birch, LLP

(57) ABSTRACT

A system for correcting skew of a web of material being fed through a machine includes first and second pinch assemblies placed at a distance transversely to a direction of feeding. First and second stepper motors drive the first and second pinch assemblies, respectively. A control provides first and second pulse trains to drive the first and second stepper motors, respectively. A device determines a value for the skew of the web of material. A method for controlling the system includes establishing first and second corrective pulse train sections for the first and second stepper motors, respectively, in accordance with a determined skew value, and providing first and second pulse trains for driving the first and second stepper motors, respectively.

18 Claims, 2 Drawing Sheets

SKEW CORRECTION SYSTEM AND METHOD OF CONTROLLING A SKEW CORRECTION SYSTEM

CROSS-REFERENCE TO RELATED APPLICATIONS

This nonprovisional application claims priority under 35 U.S.C. § 119(a) on Patent Application No. 05111302.5, filed in the European Patent Office on Nov. 25, 2005, the entirety of which is incorporated herein by reference.

BACKGROUND OF THE INVENTION

1. Field of the Invention

The present invention relates to a method of controlling a system for correcting skew of a web of material being fed through a machine. The present invention also relates to a system for correcting skew of a web of material being fed through a machine. The present invention further relates to an apparatus, in particular for printing on a web of material, comprising a sheet feed path including a registration module. The invention also relates to a computer program.

2. Description of Background Art

Respective examples of such a method, system and apparatus are known. For example, U.S. Pat. No. 5,917,727 discloses a registration system that positions a sheet being transported along a path so that the sheet is properly aligned with a printer. In operation, first and second stepper motors rotate at a substantially similar and predetermined speed so that first and second roller pairs rotate and transport the sheets. As the sheet is being transported, it will pass through the first and second roller pairs and the leading edge will trip first and second sensors. A control system can measure the interval between the moments when the first and second sensors are tripped. In response, the control system will create a speed differential between the first and second stepper motors by increasing the speed of one stepper motor and decreasing the speed of the other stepper motor. The controller will also cause a phase differential between steps in the first and second stepper motors. The magnitude of the speed change for the first and second stepper motors is approximately the same, so that the mean speed of the sheet will remain substantially the same as it is being rotated. Once the sheet is shifted to a second position wherein the leading edge is substantially perpendicular to the transport path, the first and second stepper motors are returned to substantially the same speed and the phase differential between the steps is returned to approximately zero.

A problem of the known system is that it only allows a skew correction by turning one of the first and second roller pairs over a larger distance than the other with the difference being commensurate with an integer number of steps of a stepper motor. Thus, the displacement provided in response to one step pulse by a stepper motor and the transmission system connecting it to the roller it is driving limits the resolution. An increase in resolution is attainable by using an appropriate transmission ratio in the transmission system. However, this only functions when the stepper motor is driven at high frequencies. Otherwise, skew correction would take too long. The cost of using high-frequency drivers, taking into account that the first and second stepper motors are driven independently, is an obstacle to adaptation of the transmission system in this way.

SUMMARY OF THE INVENTION

It is an object of the present invention to provide a method, system, apparatus and computer program of the types mentioned above, which allow a relatively high resolution in the correction of skew in a relatively economical way.

This object is achieved by the method according to the present invention, which is characterised by establishing the first and second corrective pulse train sections such as to commence the periodic successions of pulses with phases differing between the first and second pulse trains in accordance with the determined skew value.

Because the periodic successions of pulses commence with different phases, it is possible to introduce a relative displacement between the first and second pinch assemblies that is smaller than that resulting from a difference of one step between the motors. Because of this, the displacement resulting from one step can be kept relatively large. Therefore, the pulse trains need not be generated by apparatus operating at very high frequencies. Furthermore, the method also functions with stepper motors that are not capable of being driven in half-step or quarter-step mode.

In particular, the present invention is directed to a method of controlling a system for correcting skew of a web of material being fed through a machine, wherein the system comprises first and second pinch assemblies placed at a distance transversely to a direction of feeding; first and second stepper motors for driving the first and second pinch assemblies, respectively; means for providing first and second pulse trains to drive the first and second stepper motors, respectively; and means for determining a value for the skew of the web of material, which method includes establishing first and second corrective pulse train sections for the first and second stepper motors, respectively, in accordance with a determined skew value, and providing first and second pulse trains for driving the first and second stepper motors, respectively, wherein the first pulse train includes the first corrective pulse train section and a subsequent periodic succession of pulses at a pre-determined nominal frequency, and wherein the second pulse train includes the second corrective pulse train section and a subsequent periodic succession of pulses at a pre-determined nominal frequency.

In an embodiment of the method of the present invention, each corrective pulse train section comprises at least a first section, including a succession of pulses, each pulse following upon a preceding pulse after an associated time interval, so as to drive a stepper motor at a substantially constant average speed.

The effect is to make the establishment of the corrective pulse sections easier, since only one required value for the average time interval between pulses need be calculated. In practice, this time interval may fluctuate slightly about the calculated required average value.

In a variant of this embodiment of the method of the present invention, each corrective pulse train section further comprises at least a second section including at least one pulse, each pulse in the second section is provided at an interval from a preceding pulse having a value between the values of the time intervals associated with the pulses in the first section and a period corresponding to the pre-determined nominal frequency of the subsequent periodic succession of pulses.

This ensures smooth transitions to or from the substantially constant average speed. In particular, the return to the speed associated with the pre-determined nominal frequency.

In a further embodiment of the method of the present invention, the first and second corrective pulse train sections are established such that, in the respective first sections of the first and second corrective pulse train sections, corresponding pulses each follow upon a preceding pulse after an associated time interval longer than a nominal time interval by a first amount in one of the first and second corrective pulse train sections and shorter than the nominal time interval in the other of the first and second corrective pulse train sections by an amount substantially equal to the first amount.

Thus, the speed of one of the pinch assemblies is increased and that of the other is decreased by substantially the same amount when the first and second corrective pulse train sections are provided to the first and second stepper motors. This limits jumps in the velocity profiles of the respective pinch assemblies to the largest extent. In effect, the correction of the skew is "divided" equally over the two pinch assemblies.

In another embodiment of the method of the present invention, the first and second corrective pulse train sections are established by calculating a longer time interval between pulses in the first section of one and a shorter time interval between pulses in the first section of the other of the first and second corrective pulse train sections, so as to be commensurate with the determined skew value and a pre-determined duration of the first sections, determining the difference between the number of steps executed by the first and second stepper motors when driven by providing the first sections of the pre-determined duration, and decrementing the number of pulses in the first sections of the first and second corrective pulse train sections, such that a correction of the skew resulting from the difference between the number of steps executed by the first and second stepper motors is smaller than the determined skew value.

The time intervals are commensurate with the determined skew value and a pre-determined duration of the first sections in the sense that they are calculated to result in a correction of the skew substantially equal to the determined skew value when provided to the first and second stepper motors. The duration and time interval between pulses determines the number of pulses in each of the first sections. The difference between the number of pulses in the respective first sections of the first and second pulse train sections determines the major part of a skew correction, with a small additional correction being provided by a phase shift. The effect of ensuring that the major part is smaller than the determined skew value, is to ensure that the phase shift does not result in the unintended dropping of a pulse. Furthermore the smoothness of velocity transitions is enhanced. The phase of the pulse train provided to the "faster" stepper motor is advanced, and that of the pulse train to the "slower" stepper motor is retarded, in order to effect the extra correction.

A variant of the method of the present invention includes determining an average of the longer and the shorter time interval, calculating a difference between the skew value and a correction of the skew resulting from the difference between the number of steps executed by the first and second stepper motors when driven by providing the first sections, calculating a difference time corresponding to the difference between the determined skew value and the correction of the skew, and establishing the first and second corrective pulse train sections such that each pulse in a second section subsequent to the first section including pulses associated with the longer time interval is provided at an interval from a preceding pulse equal to the average increased by a fraction of half the difference time, the fraction being inversely proportional to the number of pulses in the second section, and such that each pulse in a second section subsequent to the first section including pulses associated with the shorter time interval is provided at an interval from a preceding pulse equal to the average decreased by a fraction of half the difference time, the fraction being inversely proportional to the number of pulses in the second section.

This further enhances the smoothness of the transition from the corrective sections to the subsequent periodic succession of pulses at the pre-determined nominal frequency.

In another embodiment of the method of the present invention, the system for correcting skew comprises non-volatile memory, and wherein the first and second pulse trains are respectively provided by first and second pulse generators, wherein each corrective pulse train section further comprises at least a second section including at least one pulse, each pulse in the second section is provided at an interval from a preceding pulse having a value retrieved from a table in the non-volatile memory by one of the first and second pulse generators.

The table provides an efficient way of ensuring a smooth ramp up or down to the velocity of the pinch assembly that results from providing the periodic succession of pulses at the pre-determined nominal frequency. The difference in phase between the pulse trains to the first and second stepper motors may be introduced by commencing the second section at a different point in time.

In another embodiment of the method of the present invention, the first and second pulse trains are respectively provided by first and second pulse generators provided with a clock signal, which method includes providing to the first and second pulse generators input values specifying the associated time intervals in increments of a clock count, wherein, to provide a first section of one of the first and second corrective pulse train sections, each time interval is specified as the sum of a number of counts that is constant throughout the first section and a varying number of zero or more counts, such that a running average of the associated time intervals in the first section approximates a time interval equal to a sum of a constant integer number of clock counts and a fraction of a clock count.

This increases the range of values of time intervals between pulses, on the basis of which a correction to the skew may be achieved. The difference in phase between the first and second pulse trains can be introduced in the first sections. One need only calculate the effective time interval between pulses that is needed to introduce the phase shift. That is to say that one value for each pulse train need be calculated. The phase shift can effectively be divided over many pulses, instead of having to be applied by adjustment of a single interval between pulses.

According to another aspect of the present invention, the system for correcting skew of a web of material being fed through a machine is characterised in that the control device is configured to establish the first and second corrective pulse train sections such as to commence the subsequent periodic successions of pulses with phases differing between the first and second pulse trains in accordance with the determined skew value.

The system has the advantage of being able to correct skew by less than one step of a stepper motor without relying on half-step or quarter-step stepper motors, high-frequency stepper motor drivers, or other relatively expensive hardware.

In particular, the present invention is directed to a system for correcting skew of a web of material being fed through a machine, wherein the system comprises first and second pinch assemblies placed at a distance transversely to a direction of feeding; first and second stepper motors for driving the first and second pinch assemblies, respectively; means for providing first and second pulse trains to drive the first and second stepper motors, respectively; means for determining a value for the skew of the web of material, a control device for establishing first and second corrective pulse train sections for driving the first and second stepper motors, respectively, in accordance with a determined skew value, and an apparatus for providing, under control of the control device, first and second pulse trains for driving the first and second stepper motors, respectively such that the first pulse train includes the first corrective pulse train section and a subsequent periodic succession of pulses at a pre-determined nominal frequency, and such that the second pulse train includes the second corrective pulse train section and a subsequent periodic succession of pulses at a predetermined nominal frequency.

In an embodiment of the system of the present invention, the control device is configured to execute the method according to the present invention.

According to another aspect of the present invention, there is provided an apparatus, in particular for printing on a web of material, comprising a sheet feed path including a registration module, wherein the registration module comprises a system for correcting skew according to the invention.

According to another aspect of the invention, there is provided a computer program including a set of instructions capable, when incorporated in a machine-readable medium, of causing a system having information processing capabilities to perform a method according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
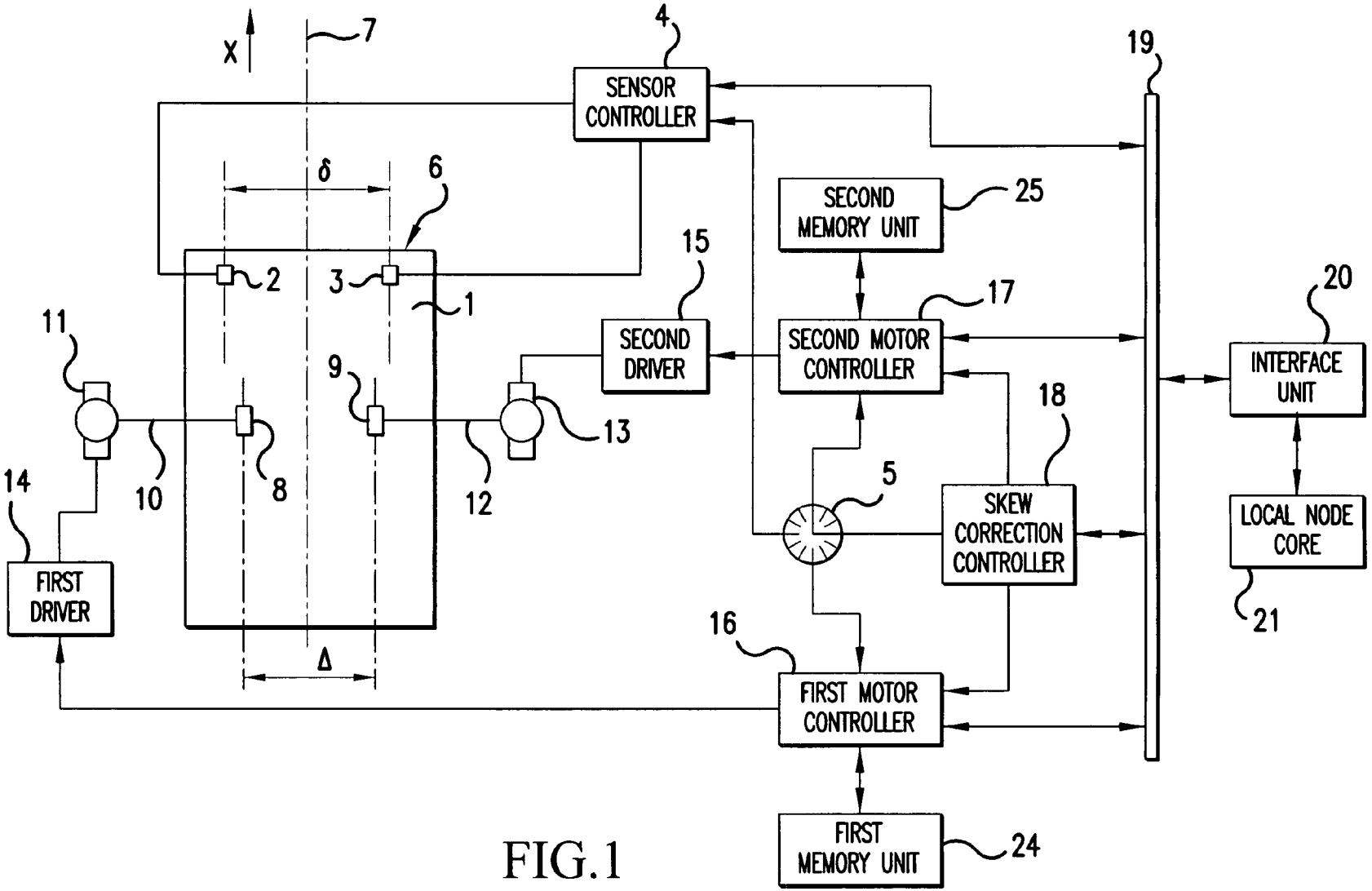
FIG. 1 is a schematic view illustrating several components of a system for correcting skew of a sheet of paper.

The system for correcting skew that is illustrated in FIG. 1 will be used as an example to explain two basic embodiments of a method of correcting skew. The system illustrated is suited for correcting skew of a sheet 1 of material, for example a sheet of paper, being fed through a machine. The machine may be a printer apparatus, for example, such as a laser printer, photocopier, offset-printer, etc. In such machines, the sheet of paper that is fed to a printing unit must be aligned accurately with the printing device, for example the drum on which the toner is arranged. For this purpose, the system for correcting skew is comprised in a registration module in a paper feed. The system for correcting skew is advantageously enhanced by a system for correcting misalignment in a direction transverse to the direction of feeding, designated as "X" in FIG. 1. The components for correcting such misalignment have been left out of the drawing to avoid confusion.

As shown in FIG. 1, the system comprises a system for measuring skew of the sheet 1. The system for measuring skew comprises a first sheet sensor 2 and a second sheet sensor 3, as well as a sensor controller 4. The sensor controller 4 is provided with a clock signal from a clock 5. The first and second sheet sensors 2,3 detect the arrival of a leading edge 6 of the sheet 1. The first and second sheet sensors 2,3 are placed apart over a distance δ measured transversely to the direction X of feeding. They are placed on either side of a central axis 7 of a sheet path. The sensor controller 4 determines the interval of time between detection of the leading edge by the first sheet sensor 2 and detection of the leading edge by the second sheet sensor 3. This time interval is measured in terms of the number of counts of the clock signal, and is designated as $\Delta t_{cnt_sensor}$. It is a value representative of the skew of the sheet 1.

To correct the skew, the system shown in FIG. 1 comprises a first pinch assembly and a second pinch assembly. The first pinch assembly comprises a first driven wheel 8, and the second pinch assembly comprises a second driven wheel 9. Belts could be used instead of the first and second driven wheels 8,9. Each pinch assembly comprises at least one further wheel, belt or brush for pressing the sheet 1 against the driven wheel 8,9 or belt. A first transmission mechanism 10 connects a shaft of a first stepper motor 11 to the first driven wheel 8. A second transmission mechanism 12 connects a shaft of a second stepper motor 13 to the second driven wheel 9.

Stepper motors are known per se. They comprise a fixed number of magnetic poles determining the number of steps per revolution and a set of electromagnets, controlled electronically. A pulse train determines the switching of the electromagnets to advance the motor by one step. Advanced stepper motors and controllers allow for a mode of driving wherein the stepper motor advances half a step, or a quarter of a step, with each pulse. The methods outlined herein function in any mode. Stepper motors have the feature of providing holding torque, enabling their position to be controlled relatively precisely without closed-loop control. Thus, they are both economical and accurate.

As shown in FIG. 1, the system for correcting skew has the first and second driven wheels placed apart transversely to the central axis over a distance Δ. The axes of rotation of the first and second driven wheels 8,9 are aligned, although they could also be substantially parallel to each other without being aligned.

In the illustrated embodiment, the first and second transmission systems 10,12 have the same gearing. The first and second driven wheels 8,9 have approximately the same diameter. The first and second stepper motors 11,13 have the same number of steps per revolution. Thus, control of the system for correcting skew is simplified. In more complicated embodiments, account would be taken of differences in characteristics to adjust pulse trains provided to first and second drivers 14,15 by first and second motor controllers 16,17.

In FIG. 1, the first and second drivers 14,15 are shown as being separate from the first and second stepper motors 11,13. In an alternative embodiment, the first and second drivers 14,15 are incorporated in the first and second stepper motors 11,13 respectively, so that a stepper motor is driven by providing a pulse train directly to it.

A skew correction controller 18 switches the operating state of the first and second motor controllers 16,17. The motor controllers 16,17 and skew correction controller 18 also operate according to clock signals provided by the clock 5. The motor controllers 16,17, skew correction controller 18 and sensor controller 4 are each connected to a bus 19. An interface unit 20 connects a local node core (LNC) 21 to the bus 19. The local node core 21 has microcontroller functionality. The motor controllers 16,17, skew correction controller 18 and sensor controller 4 are advantageously implemented as a Field Programmable Gate Array (FPGA), in order to meet real time performance requirements. In the illustrated implementation, the LNC 21 sets values of intervals at which pulses follow each other in the pulse trains generated by the first and second motor controllers 16,17. To this end, the LNC 21 can retrieve a value representative of the skew from the sensor controller 4.

A time interval $\Delta t_{cnt_sensor}$ between detection of the leading edge 6 by the first sensor 2 and second sensor 3 , measured in terms of a number cnt_sensor of clock counts, is converted to a time interval $\Delta t_{cnt_fault}$, measured in terms of a number cnt_fault of clock counts, between arrival of the leading edge 6 at the first driven wheel 7 and the second driven wheel 8. For this purpose, the following equation is used:

$$\Delta t_{\text{cnt_fault}} = \frac{\Delta}{\delta} \cdot \Delta t_{\text{cnt_sensor}} \tag{1}$$

Figure 2:
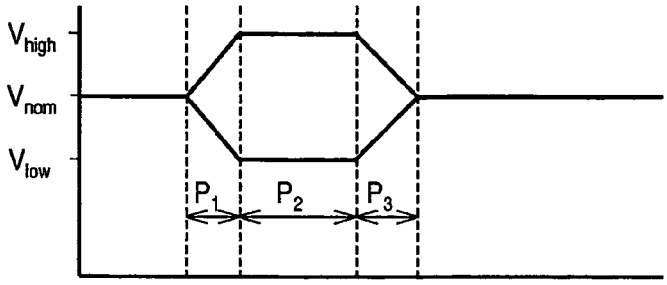
FIG. 2 is a schematic view illustrating velocity profiles of pinch assemblies in the system for correcting skew.

In order to correct the skew, one of the first and second driven wheels 8,9 is temporarily driven at an increased velocity $V_{high}$, whilst the other is driven at a decreased velocity $V_{low}$. This is illustrated in FIG. 2. During a first period $P_1$ the velocity is ramped up or down from a nominal velocity $V_{nom}$, at which both the first and second driven wheels 8,9 were previously rotating. The first period $P_1$ may be so short that only one pulse is supplied to the stepper motors 11,13 concerned. During a second period $P_2$, one of the first and second driven wheels 8,9 is at the increased velocity $V_{high}$, whilst the other is at the decreased velocity $V_{low}$. Then, the velocity profile shows a ramp over a period $P_3$, during which the velocities of both the first and second driven wheels 8,9 return to the nominal velocity $V_{nom}$.

Whereas the first, second and third periods $P_1$-$P_3$ are shown in FIG. 2 to coincide substantially for the two driven wheels 8,9, this is not the case on time scales of the same order as the period of the pulses supplied to the first and second stepper motors 11,13. On that time scale, one of the first and second driven wheels 8,9 returns to the nominal velocity $V_{nom}$ slightly earlier than the other. In the first embodiment to be described herein, this is partly due to a different duration of the third period $P_3$. In the second embodiment, the ramps associated with the first and second driven wheels 8,9 are each other's mirror image, but commence at different points in time.

The angular velocity of a stepper motor is in principle directly proportional to the frequency of the pulses in the pulse train driving it. Thus, the velocity profiles shown in FIG. 2 are obtained by providing a first corrective pulse train section to the first driver 14 and a second corrective pulse train section to the second driver 15. Subsequently, an identical periodic succession of pulses—with a frequency corresponding to the nominal velocity $V_{nom}$—is provided to each of the first and second drivers 14,15. However, the periodic succession of pulses provided to one of the first and second drivers 14,15 lags that provided to the other in phase, because it commences with a different phase. The following description will assume that the nominal frequencies are the same for the first and second stepper motors 11,13 because this corresponds to a straight path for the sheet 1, which is the most likely situation.

Figure 3:
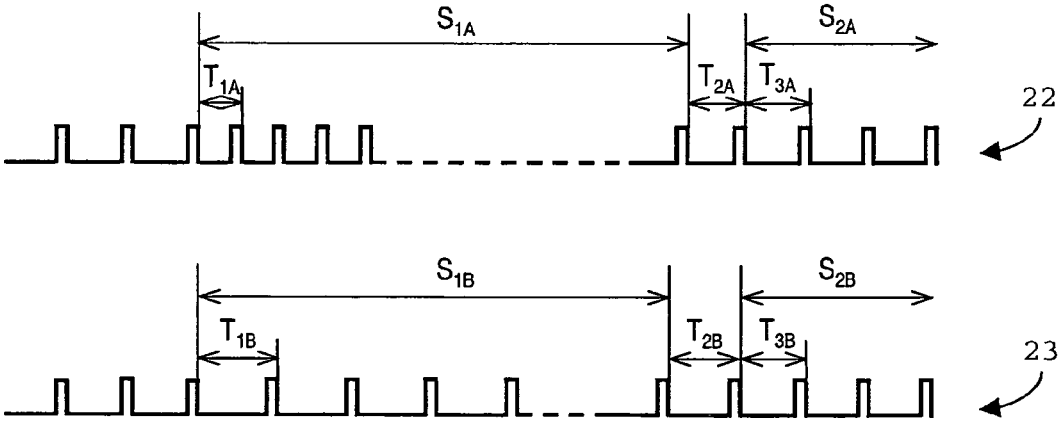
FIG. 3 is a schematic view illustrating pulse trains provided to stepper motors in one embodiment of a method for correcting skew.

A first embodiment of the method for correcting skew is illustrated in FIG. 3. FIG. 3 shows first and second pulse trains 22,23 as are provided to the first and second stepper drivers 14,15, respectively. The first pulse train 22 comprises a first section $S_{1A}$, consisting of a succession of pulses, each pulse following upon a preceding pulse after an associated time interval $T_{1A}$, so as to drive the first stepper motor 11 at a substantially constant average speed, corresponding to the increased velocity $V_{high}$ indicated in FIG. 2. A second section includes exactly one pulse, provided at an interval $T_{2A}$ from the last pulse in the first section $S_{1A}$. This interval $T_{2A}$ has a value between the time interval $T_{1A}$ between pulses in the first sections $S_{1A}$ and a period $T_{3A}$ that is the inverse of the nominal frequency corresponding to the nominal velocity $V_{nom}$. The pulse following the interval $T_{2A}$ is followed by the first of a periodic succession $S_{2A}$ of pulses at the nominal frequency. Note that in this description, time intervals are indicated as intervals between corresponding pulse edges, e.g. the trailing edges in FIG. 3.

The second pulse train 23 is similar to the first pulse train 22. It, too, comprises a corrective pulse train section comprising a first section $S_{1B}$. This first section $S_{1B}$ consists of a succession of pulses, each following upon a preceding pulse after an associated time interval $T_{1B}$. The time interval $T_{1B}$ is the inverse of the frequency needed to drive the second stepper motor 13 at a speed corresponding to the decreased velocity $V_{low}$ in FIG. 2. The time interval $T_{1B}$ remains substantially constant throughout the first section $S_{1B}$. The last pulse of the first section $S_{1B}$ is succeeded by a pulse at an interval $T_{2B}$, which marks the end of the second corrective pulse train section. The second corrective pulse train section is followed by a periodic succession $S_{2B}$ of pulses at equidistant intervals $T_{3B}$ equal to the inverse of the nominal frequency needed to operate the second stepper motor 13 at the nominal velocity $V_{nom}$. As explained above, this interval $T_{3B}$ equals the corresponding interval $T_{3A}$ in the first pulse train 22, but the periodic succession $S_{2B}$ commences at a different time, introducing a phase difference between the two periodic successions $S_{2A}$,$S_{2B}$.

In the first embodiment of the method of correcting skew, the first and second corrective pulse train sections are established such that, in the respective first sections $S_{2A}$,$S_{2B}$ of the first and second corrective pulse train sections, corresponding pulses each follow upon a preceding pulse after an associated time interval longer than a nominal time interval by a first amount in one of the first and second corrective pulse train sections and shorter than the nominal time interval in the other of the first and second corrective pulse train sections by an amount substantially equal to the first amount. Thus, the increased velocity $V_{high}$ is higher than the nominal velocity $V_{nom}$ by the same amount as the decreased velocity $V_{low}$ is lower. The correction of the skew is "divided equally" over the two stepper motors 11,13. Substantial equality in this context means a difference of only a few, preferably not more than two, counts of the clock signal provided by the clock 5.

The LNC 21, or alternatively the skew correction controller 18, calculates the time intervals $T_{1A}$, $T_{1B}$ between pulses in the first sections $S_{1A}$, $S_{1B}$ so as to achieve skew correction within first sections $S_{1A}$, $S_{1B}$ of pre-determined duration $\Delta t_{cnt_corr}$. Combined with the fact that the speeds of the two driven wheels 8,9 are at equal intervals to a nominal speed, this has the effect that the sheet 1 passes through the skew correction system in approximately a pre-determined time. Thus, the apparatus in which the skew correction system is incorporated need not adjust the other components of the sheet feed mechanism in dependence on the skew correction.

Assuming that there are $N_A$ pulses in the first section $S_{1A}$ of the first corrective pulse train section and $N_B$ pulses in the first section $S_{1B}$ of the second corrective pulse train section, the following equation applies:

$$\Delta t_{cnt_corr}=T_{1A}\cdot N_A=T_{1B}\cdot N_B. \quad (2)$$

Furthermore, at roll distance Δ, the leading edge is ahead of itself over a distance $V_{nom}\cdot\Delta t_{cnt_fault}$. This is to be corrected by means of two equal velocity differences, leading to the following equation:

$$V_{nom}\cdot\Delta t_{cnt_fault}=2\cdot V_{nom}\cdot\Delta t_{cnt_corr}-V_{low}\cdot\Delta t_{cnt_corr}-V_{high}\cdot\Delta t_{cnt_corr}. \quad (3)$$

Bearing in mind that the velocity is inversely proportional to the time interval between pulses, it is possible to calculate the time interval $T_{1A}$ for the first stepper motor 11 (with increased speed) as follows:

$$T_{1A}=\frac{\Delta t_{\text{cnt_corr}}\cdot\Delta t_{\text{cnt_nom}}}{\Delta t_{\text{cnt_corr}}+\Delta t_{\text{cnt_fault}}/2}. \quad (4)$$

The time interval $T_{1B}$ for the second stepper motor 13 (with decreased speed) conforms to the following equation:

$$T_{1B}=\frac{\Delta t_{\text{cnt_corr}}\cdot\Delta t_{\text{cnt_nom}}}{\Delta t_{\text{cnt_corr}}-\Delta t_{\text{cnt_fault}}/2}. \quad (5)$$

The results of all divisions are rounded down to the nearest integer number in one embodiment. In another embodiment, this is not necessary, due to the use of a special method to generate the pulse trains in the first and second motor controllers 16,17 . This will be explained below in the context of a description of a second method of correcting skew.

The number of pulses in the first section $S_{1A}$ applied to drive the faster, first stepper motor 11, is:

$$N_A=\Delta t_{cnt_corr}/T_{1A}=\Delta t_{cnt_corr}/\Delta t_{cnt_nom}+\Delta t_{cnt_fault}/2\cdot\Delta t_{cnt_nom}, \quad (6)$$

where $\Delta t_{cnt_nom}$ is the time interval corresponding to the nominal frequency, on which the calculation is based. Similarly, the number of pulses applied to drive the slower, second stepper motor 13 when the first section $S_{1B}$ is provided, is:

$$N_B=\Delta t_{cnt_corr}/T_{1B}=\Delta t_{cnt_corr}/\Delta t_{cnt_nom}-\Delta t_{cnt_fault}/2\cdot\Delta t_{cnt_nom}. \quad (7)$$

To establish the definitive forms of the first sections $S_{1A}$, $S_{1B}$, the LNC 21 compares the resulting skew correction with the determined value of the skew, i.e. the skew to be corrected. The numbers $N_A$,$N_B$ of steps in the first sections of the first and second corrective pulse train sections, are decremented such that a correction of the skew resulting from the difference between the number of steps executed by the first and second stepper motors is smaller than the determined skew value. The effect is that a final correction of the skew must be accomplished by an appropriate choice of values for the respective time intervals $T_{2A}$, $T_{2B}$ to the first pulse following the first sections $S_{1A}$,$S_{1B}$. The final correction also ensures that the correct phase difference between the subsequent periodic successions $S_{2A}$,$S_{2B}$ of pulses is established.

To accomplish a relatively smooth ramp in the velocity profiles, the shorter of the two time intervals $T_{2A}$, $T_{2B}$ is chosen to be shorter than the average of the time intervals $T_{1A}$, $T_{1B}$ in the first sections $S_{1A}$, $S_{1B}$ by a first amount, and the longer of the two time intervals $T_{2A}$, $T_{2B}$ chosen to be longer by the same amount. Instead of choosing the average of the two time intervals $T_{1A}$, $T_{1B}$, the nominal time interval $\Delta t_{cnt_nom}$ could also have been chosen as a reference. The two coincide where no rounding errors have been introduced in establishing the time intervals $T_{1A}$, $T_{1B}$. Choosing the average makes the transition smoother.

The two time intervals $T_{2A}$, $T_{2B}$ are calculated as follows:

$$T_{2A}=T_{1A}+T_{1B}/2-½(\Delta t_{cnt_fault}-|N'_A\cdot T_{1A}-N'_B\cdot T_{1B}|), \quad (8)$$

$$T_{2B}=T_{1A}+T_{1B}/2+½(\Delta t_{cnt_fault}-|N'_A\cdot T_{1A}-N'_B\cdot T_{1B}|), \quad (9)$$

where $\acute{N}_A$ and $\acute{N}_B$ are the numbers of pulses in the first sections $S_{1A}$ and $S_{1B}$ after decrementing to ensure that the first sections lead to a correction smaller than the determined skew value.

The first embodiment of the method of correcting skew, which has just been described, introduces a phase shift by an appropriate choice of time intervals $T_{2A}$, $T_{2B}$ in the sections of the corrective pulse train section that follow the first sections $S_{1A}$,$S_{1B}$, i.e. in the ramps to the nominal pulse train frequency. In the first sections $S_{1A}$, $S_{1B}$, the skew is corrected by an amount corresponding to an integer number of pulses to the first and second drivers 14,15. The first embodiment could be varied by having these time intervals $T_{2A}$, $T_{2B}$ precede the first sections $S_{1A}$,$S_{1B}$. In a slightly more distinct embodiment, the phase difference is introduced exclusively in the first sections, and the ramps are executed by applying identical sequences of pulses at pre-determined time intervals. These are pre-determined in the sense that they are not dependent on the determined skew.

The calculations for the second embodiment proceed essentially as outlined above for the first embodiment. However, the time intervals $T_{2A}$, $T_{2B}$ as calculated by means of equations (8) and (9) must now be divided over the intervals between pulses in the first sections $S_{1A}$,$S_{1B}$. The adjusted average intervals $T_{1A}$,$T_{1B}$ between pulses become:

$$T'_{1A}=T_{1A}+T_{2A}/N'_A, \quad (10)$$

and $$T'_{1B}=T_{1B}+T_{2B}/N'_B, \quad (11)$$

where $T_{1A}$ is calculated in accordance with equation (4) and $T_{1B}$ is calculated in accordance with equation (5).

The values obtained from equations (10) and (11) are unlikely to be integer values, and cannot simply be truncated. Thus, although the pulses in the first sections $S_{1A}$and $S_{1B}$ are provided at substantially constant intervals to an accuracy on a scale of several counts of the clock signal from the clock 5, the intervals actually fluctuate slightly so that a running average of the time intervals over the first sections $S_{1A}$, $S_{1B}$ approximates an interval equal to the sum of an integer number of clock counts and a fraction of a clock count. To this end, the first and second motor controllers 16,17 perform a noise shaping algorithm to arrive at average intervals as determined by the LNC 21 on the basis of equations (10) and (11). In principle, the same could be done in a variant of the first embodiment. Note, however, that the exact average value of the interval $T_{1A}$,$T_{1B}$ between pulses is less critical in that case. The effect in that embodiment would be to ensure that the average speed of the stepper motors 11,13 is more precisely equal to the nominal speed that formed the starting point for establishing the corrective pulse train sections.

Returning to the second embodiment, the first sections of the first and second corrective pulse train sections are followed by second sections including at least one pulse, preferably several. Each pulse in the second section is provided at an interval from a preceding pulse having a value between the values of the time intervals $T_{1A}$,$T_{1B}$ between pulses in the first sections and a period corresponding to the pre-determined nominal frequency of the subsequent periodic succession of pulses.

Where there are several pulses in the second sections, the values of the intervals between pulses are preferably read from tables stored in first and second memory units 24,25, connected to, or associated with, the first and second motor controllers 16,17 , respectively. The first and second memory units 24,25 may be comprised in a single memory device. The tables stored in the first and second memory units 24,25 are identical in the envisaged embodiment. This simplifies the calculations carried out by the LNC 21, especially where the first and second stepper motors 11,13 are of the same type.

The LNC 21 provides the first and second motor controllers 16,17 with indices to the tables in the first and second memory units 24,25. With these, the first and second motor controllers 16,17 retrieve the time interval values. The first motor controller 16 is provided with indices in reverse order to the second motor controller 17. Thus, one of the first and second stepper motors 11,13 ramps up whilst the other ramps down in speed.

Because the first sections in the first and second corrective pulse train sections are different in length by a fraction of the inverse of the nominal frequency of the succession of pulses following the corrective pulse train sections, a phase difference is introduced. This phase difference remains, since the time interval values stored in the first and second memory units 24,25 are the same. The second sections of the first and second corrective pulse train sections are thus of the same length, but commence at different points in time.

The invention is not limited to the embodiments described above, which can be varied within the scope of the claims. For example, the system and methods described above are also suitable for correcting skew of a (quasi-) endless web of material, provided a different system for measuring skew is employed. For example, the web may be provided with markings, the arrival of which is detected by sensors placed transversely with respect to the direction of feeding of the web.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling a system for correcting skew of a web of material being fed through a machine, wherein the system comprises first and second pinch assemblies placed at a distance transversely to a direction of feeding; first and second stepper motors that drive the first and second pinch assemblies, respectively; a control that provides first and second pulse trains to drive the first and second stepper motors, respectively; and a device that determines a value for the skew of the web of material, said method comprising the steps of:

establishing first and second corrective pulse train sections for the first and second stepper motors, respectively, in accordance with a determined skew value;

providing first and second pulse trains for driving the first and second stepper motors, respectively, wherein the first pulse train includes the first corrective pulse train section and a subsequent periodic succession of pulses at a pre-determined nominal frequency, and wherein the second pulse train includes the second corrective pulse train section and a subsequent periodic succession of pulses at a pre-determined nominal frequency; and establishing the first and second corrective pulse train sections to commence the periodic successions of pulses with phases differing between the first and second pulse trains in accordance with the determined skew value.

2. The method according to claim 1, wherein each corrective pulse train section comprises at least a first section, including a succession of pulses, each pulse following upon a preceding pulse after an associated time interval, so as to drive the first and second stepper motors at a substantially constant average speed.

3. The method according to claim 2, wherein each corrective pulse train section further comprises at least a second section including at least one pulse, wherein each pulse in the second section is provided at an interval from a preceding pulse having a value between the values of the time intervals associated with the pulses in the first section and a period corresponding to the pre-determined nominal frequency of the subsequent periodic succession of pulses.

4. The method according to claim 2, wherein the first and second corrective pulse train sections are established such that, in the respective first sections of the first and second corrective pulse train sections, corresponding pulses each follow upon a preceding pulse after an associated time interval longer than a nominal time interval by a first amount in one of the first and second corrective pulse train sections and shorter than the nominal time interval in the other of the first and second corrective pulse train sections by an amount substantially equal to the first amount.

5. The method according to claim 3, wherein the first and second corrective pulse train sections are established such that, in the respective first sections of the first and second corrective pulse train sections, corresponding pulses each follow upon a preceding pulse after an associated time interval longer than a nominal time interval by a first amount in one of the first and second corrective pulse train sections and shorter than the nominal time interval in the other of the first and second corrective pulse train sections by an amount substantially equal to the first amount.

6. The method according to claim 2, wherein the first and second corrective pulse train sections are established by calculating a longer time interval between pulses in the first section of one and a shorter time interval between pulses in the first section of the other of the first and second corrective pulse train sections, so as to be commensurate with the determined skew value and a pre-determined duration of the first sections, determining the difference between the number of steps executed by the first and second stepper motors when driven by providing the first sections of the pre-determined duration, and decrementing the number of pulses in the first sections of the first and second corrective pulse train sections, such that a correction of the skew resulting from the difference between the number of steps executed by the first and second stepper motors is smaller than the determined skew value.

7. The method according to claim 3, wherein the first and second corrective pulse train sections are established by calculating a longer time interval between pulses in the first section of one and a shorter time interval between pulses in the first section of the other of the first and second corrective pulse train sections, so as to be commensurate with the determined skew value and a pre-determined duration of the first sections, determining the difference between the number of steps executed by the first and second stepper motors when driven by providing the first sections of the pre-determined duration, and decrementing the number of pulses in the first sections of the first and second corrective pulse train sections, such that a correction of the skew resulting from the difference between the number of steps executed by the first and second stepper motors is smaller than the determined skew value.

8. The method according to claim 4, wherein the first and second corrective pulse train sections are established by calculating a longer time interval between pulses in the first section of one and a shorter time interval between pulses in the first section of the other of the first and second corrective pulse train sections, so as to be commensurate with the determined skew value and a pre-determined duration of the first sections, determining the difference between the number of steps executed by the first and second stepper motors when driven by providing the first sections of the pre-determined duration, and decrementing the number of pulses in the first sections of the first and second corrective pulse train sections, such that a correction of the skew resulting from the difference between the number of steps executed by the first and second stepper motors is smaller than the determined skew value.

9. The method according to claim 5, wherein the first and second corrective pulse train sections are established by calculating a longer time interval between pulses in the first section of one and a shorter time interval between pulses in the first section of the other of the first and second corrective pulse train sections, so as to be commensurate with the determined skew value and a pre-determined duration of the first sections, determining the difference between the number of steps executed by the first and second stepper motors when driven by providing the first sections of the pre-determined duration, and decrementing the number of pulses in the first sections of the first and second corrective pulse train sections, such that a correction of the skew resulting from the difference between the number of steps executed by the first and second stepper motors is smaller than the determined skew value.

10. The method according to claim 3, further comprising the steps of:

determining an average of the longer and the shorter time interval;

calculating a difference between the skew value and a correction of the skew resulting from the difference between the number of steps executed by the first and second stepper motors when driven by providing the first sections;

calculating a difference time corresponding to the difference between the determined skew value and the correction of the skew; and establishing the first and second corrective pulse train sections such that each pulse in a second section subsequent to the first section including pulses associated with the longer time interval is provided at an interval from a preceding pulse equal to the average increased by a fraction of half the difference time, the fraction being inversely proportional to the number of pulses in the second section, and such that each pulse in a second section subsequent to the first section including pulses associated with the shorter time interval is provided at an interval from a preceding pulse equal to the average decreased by a fraction of half the difference time, the fraction being inversely proportional to the number of pulses in the second section.

11. The method according to claim 6, further comprising the steps of:

determining an average of the longer and the shorter time interval;

calculating a difference between the skew value and a correction of the skew resulting from the difference between the number of steps executed by the first and second stepper motors when driven by providing the first sections;

calculating a difference time corresponding to the difference between the determined skew value and the correction of the skew; and establishing the first and second corrective pulse train sections such that each pulse in a second section subsequent to the first section including pulses associated with the longer time interval is provided at an interval from a preceding pulse equal to the average increased by a fraction of half the difference time, the fraction being inversely proportional to the number of pulses in the second section, and such that each pulse in a second section subsequent to the first section including pulses associated with the shorter time interval is provided at an interval from a preceding pulse equal to the average decreased by a fraction of half the difference time, the fraction being inversely proportional to the number of pulses in the second section.

12. The method according to claim 7, further comprising the steps of:

determining an average of the longer and the shorter time interval;

calculating a difference between the skew value and a correction of the skew resulting from the difference between the number of steps executed by the first and second stepper motors when driven by providing the first sections;

calculating a difference time corresponding to the difference between the determined skew value and the correction of the skew; and establishing the first and second corrective pulse train sections such that each pulse in a second section subsequent to the first section including pulses associated with the longer time interval is provided at an interval from a preceding pulse equal to the average increased by a fraction of half the difference time, the fraction being inversely proportional to the number of pulses in the second section, and such that each pulse in a second section subsequent to the first section including pulses associated with the shorter time interval is provided at an interval from a preceding pulse equal to the average decreased by a fraction of half the difference time, the fraction being inversely proportional to the number of pulses in the second section.

13. The method according to claim 8, further comprising the steps of:

determining an average of the longer and the shorter time interval;

calculating a difference between the skew value and a correction of the skew resulting from the difference between the number of steps executed by the first and second stepper motors when driven by providing the first sections;

calculating a difference time corresponding to the difference between the determined skew value and the correction of the skew; and establishing the first and second corrective pulse train sections such that each pulse in a second section subsequent to the first section including pulses associated with the longer time interval is provided at an interval from a preceding pulse equal to the average increased by a fraction of half the difference time, the fraction being inversely proportional to the number of pulses in the second section, and such that each pulse in a second section subsequent to the first section including pulses associated with the shorter time interval is provided at an interval from a preceding pulse equal to the average decreased by a fraction of half the difference time, the fraction being inversely proportional to the number of pulses in the second section.

14. The method according to claim 9, further comprising the steps of:

determining an average of the longer and the shorter time interval;

calculating a difference between the skew value and a correction of the skew resulting from the difference between the number of steps executed by the first and second stepper motors when driven by providing the first sections;

calculating a difference time corresponding to the difference between the determined skew value and the correction of the skew; and establishing the first and second corrective pulse train sections such that each pulse in a second section subsequent to the first section including pulses associated with the longer time interval is provided at an interval from a preceding pulse equal to the average increased by a fraction of half the difference time, the fraction being inversely proportional to the number of pulses in the second section, and such that each pulse in a second section subsequent to the first section including pulses associated with the shorter time interval is provided at an interval from a preceding pulse equal to the average decreased by a fraction of half the difference time, the fraction being inversely proportional to the number of pulses in the second section.

15. The method according to claim 2, wherein the system for correcting skew comprises a non-volatile memory, and wherein the first and second pulse trains are respectively provided by first and second pulse generators, wherein each corrective pulse train section further comprises at least a second section including at least one pulse, and wherein each pulse in the second section is provided at an interval from a preceding pulse having a value retrieved from a table in the non-volatile memory by one of the first and second pulse generators.

16. The method according to claim 2, wherein the first and second pulse trains are respectively provided by first and second pulse generators provided with a clock signal, the method further comprising the step of providing input values to the first and second pulse generators specifying the associated time intervals in increments of a clock count, wherein, to provide a first section of one of the first and second corrective pulse train sections, each time interval is specified as the sum of a number of counts that is constant throughout the first section and a varying number of zero or more counts, such that a running average of the associated time intervals in the first section approximates a time interval equal to a sum of a constant integer number of clock counts and a fraction of a clock count.

17. A system for correcting skew of a web of material being fed through a machine, comprising:

first and second pinch assemblies placed at a distance transversely to a direction of feeding;

first and second stepper motors for driving the first and second pinch assemblies, respectively;

a control that provides first and second pulse trains to drive the first and second stepper motors, respectively;

a device that determines a value for the skew of the web of material;

a control device that establishes first and second corrective pulse train sections to drive the first and second stepper motors, respectively, in accordance with a determined skew value; and an apparatus that provides, under control of the control device, first and second pulse trains that drive the first and second stepper motors, respectively such that the first pulse train includes the first corrective pulse train section and a subsequent periodic succession of pulses at a pre-determined nominal frequency, and such that the second pulse train includes the second corrective pulse train section and a subsequent periodic succession of pulses at a pre-determined nominal frequency, wherein the control device is configured to establish the first and second corrective pulse train sections such as to commence the subsequent periodic successions of pulses with phases differing between the first and second pulse trains in accordance with the determined skew value.

18. A computer program including a set of instructions that is capable, when incorporated in a machine readable medium, of causing a system having information processing capabilities to perform a method of controlling a system for correcting skew of a web of material being fed through a machine, wherein the system comprises first and second pinch assemblies placed at a distance transversely to a direction of feeding; first and second stepper motors that drive the first and second pinch assemblies, respectively; a control that provides first and second pulse trains to drive the first and second stepper motors, respectively; and a device that determines a value for the skew of the web of material, said method comprising the steps of:

establishing first and second corrective pulse train sections for the first and second stepper motors, respectively, in accordance with a determined skew value;

providing first and second pulse trains for driving the first and second stepper motors, respectively, wherein the first pulse train includes the first corrective pulse train section and a subsequent periodic succession of pulses at a pre-determined nominal frequency, and wherein the second pulse train includes the second corrective pulse train section and a subsequent periodic succession of pulses at a pre-determined nominal frequency; and establishing the first and second corrective pulse train sections to commence the periodic successions of pulses with phases differing between the first and second pulse trains in accordance with the determined skew value.

* * * * *